US006481529B1

(12) United States Patent
Voorhies

(10) Patent No.: US 6,481,529 B1
(45) Date of Patent: Nov. 19, 2002

(54) CLIMBING TREE STAND

(76) Inventor: Barry Kent Voorhies, 1666 McMahon Hollow Rd., Pleasant View, TN (US) 37146

( * ) Notice: Subject to any disclaimer, the term of this patent is extended or adjusted under 35 U.S.C. 154(b) by 0 days.

(21) Appl. No.: 09/687,756

(22) Filed: Oct. 13, 2000

(51) Int. Cl.[7] ..... A63B 27/00
(52) U.S. Cl. ..... 182/20; 182/136; 182/187
(58) Field of Search ..... 182/20, 135, 136, 182/187, 188

(56) References Cited

U.S. PATENT DOCUMENTS

| | | | | |
|---|---|---|---|---|
| 3,419,108 | A | | 12/1968 | Mobbs |
| 3,460,649 | A | | 8/1969 | Baker et al. |
| 3,856,111 | A | | 12/1974 | Baker |
| 3,871,482 | A | | 3/1975 | Southard |
| 3,944,022 | A | | 3/1976 | Ming |
| 3,955,645 | A | | 5/1976 | Dye |
| 3,960,240 | A | * | 6/1976 | Cotton ..... 182/20 |
| 4,022,292 | A | | 5/1977 | Van Gompel |
| 4,120,379 | A | | 10/1978 | Carter |
| 4,137,995 | A | | 2/1979 | Fonte |
| 4,150,733 | A | | 4/1979 | Plummer |
| 4,168,765 | A | | 9/1979 | Ferguson et al. |
| 4,230,203 | A | | 10/1980 | Sweat et al. |
| 4,316,526 | A | | 2/1982 | Amacker |
| 4,321,982 | A | | 3/1982 | Strickland |
| 4,331,216 | A | | 5/1982 | Amacker |
| 4,337,844 | A | | 7/1982 | Hice, Sr. |
| 4,362,307 | A | | 12/1982 | Nakatani |
| 4,369,858 | A | | 1/1983 | Babb |
| 4,411,335 | A | | 10/1983 | Forrester |
| 4,417,645 | A | | 11/1983 | Untz |
| 4,427,092 | A | | 1/1984 | Tentler |
| 4,428,459 | A | | 1/1984 | Peck |
| 4,452,338 | A | | 6/1984 | Untz |
| 4,475,627 | A | | 10/1984 | Eastridge |
| 4,488,620 | A | | 12/1984 | Gibson |
| 4,549,633 | A | | 10/1985 | Merritt |
| 4,582,165 | A | | 4/1986 | Latini |
| 4,589,522 | A | | 5/1986 | Shelton |
| 4,597,473 | A | | 7/1986 | Peck |
| 4,722,421 | A | | 2/1988 | Hilbert |
| 4,726,447 | A | | 2/1988 | Gibson et al. |
| 4,784,239 | A | | 11/1988 | Kirkman |
| 4,802,552 | A | | 2/1989 | Williams |
| 4,809,815 | A | | 3/1989 | Wallace |
| 4,819,763 | A | | 4/1989 | Grote |
| 4,890,694 | A | | 1/1990 | Williams |
| 4,909,353 | A | | 3/1990 | Govin et al. |
| 4,936,415 | A | | 6/1990 | Williams |
| 4,942,942 | A | | 7/1990 | Bradley |
| 4,953,662 | A | | 9/1990 | Porter |
| 4,989,766 | A | | 2/1991 | Lewallyn et al. |
| 5,052,516 | A | | 10/1991 | Jamieson |
| 5,086,874 | A | | 2/1992 | Treants |
| 5,090,504 | A | | 2/1992 | Amacker |

(List continued on next page.)

*Primary Examiner*—Alvin Chin-Shue
(74) *Attorney, Agent, or Firm*—Luedeka, Neely & Graham, P.C.

(57) ABSTRACT

A climbing tree stand includes upper and lower support assemblies for aiding an operator in climbing a tree and for supporting the operator in the tree. The upper and lower assemblies are attached to the trunk of the tree by straps that wrap around the trunk, and by cleats that are pressed into the trunk by the cantilevered weight of the assemblies. The upper assembly provides upper and lower seating positions for the operator. In both seating positions, the operator's weight is suspended below where the cleat engages the trunk of the tree. The upper seating position, which positions the operator's seat well above a railing provided by the upper assembly, is most advantageous for bow hunting. The lower seating position puts the operator's seat below the railing, allowing the operator to rest a gun on the railing when gun hunting. The stand has wheels attached to the lower assembly, and may be converted into a game cart by attaching the upper and lower assemblies together.

12 Claims, 5 Drawing Sheets

U.S. PATENT DOCUMENTS

| | | | | | |
|---|---|---|---|---|---|
| 5,090,505 | A | | 2/1992 | Amacker | |
| 5,090,506 | A | | 2/1992 | Womack et al. | |
| 5,101,933 | A | | 4/1992 | Huntley | |
| 5,101,934 | A | | 4/1992 | Zumbro | |
| 5,103,935 | A | | 4/1992 | Amacker | |
| 5,143,177 | A | | 9/1992 | Smith | |
| 5,156,236 | A | | 10/1992 | Gardner et al. | |
| 5,167,298 | A | | 12/1992 | Porter | |
| 5,257,677 | A | | 11/1993 | Stepp | |
| 5,265,780 | A | | 11/1993 | Matthews et al. | |
| 5,433,291 | A | | 7/1995 | Shoestock, Sr. | |
| 5,492,196 | A | | 2/1996 | Michno | |
| 5,588,499 | A | * | 12/1996 | Carriere | 182/187 |
| 5,624,008 | A | * | 4/1997 | Beardslee | 182/187 |
| 5,680,910 | A | * | 10/1997 | Sarphie | 182/135 |
| 5,775,464 | A | * | 7/1998 | Gardner | 182/187 |
| 5,887,676 | A | | 3/1999 | Harbin | |
| 5,971,104 | A | * | 10/1999 | Woller | 182/187 |
| 5,975,242 | A | | 11/1999 | Woller et al. | |
| 5,979,603 | A | | 11/1999 | Woller | |

* cited by examiner

CLIMBING TREE STAND

TECHNICAL FIELD

The present invention is generally directed to an apparatus for supporting a person's weight on a tree or pole. More particularly, the invention is directed to a climbing tree stand for aiding a hunter in climbing a tree, and for supporting the hunter above the ground in the tree.

BACKGROUND OF THE INVENTION

It is well understood by deer hunters that an advantage may be gained by elevating themselves well above the deer, such as up in a tree. When the hunter is in an elevated position, a deer is less likely to see or smell the hunter. The elevated position also gives the hunter a better view of the approaching deer, and often times, a better shooting angle.

Although there are several commercially-available devices that aid a hunter in climbing a tree, and in supporting the hunter while in the tree, these known devices are lacking in several respects. Many of the devices are unsafe, in that they may lose their grip on the tree if the hunter shifts his weight in one direction or another. Many of the devices do not offer the hunter the flexibility of sitting or standing, or of choosing the height of the sitting position relative to the device structure. Most of the devices are unwieldy and difficult to use.

Therefore, what is needed is a climbing tree stand that provides safety, flexibility, and ease of use.

SUMMARY OF THE INVENTION

The foregoing and other needs are met by an apparatus for aiding an operator in attaining an elevated position in a tree or the like, and for providing support for the operator while in the elevated position. The apparatus includes an upper support assembly and a lower support assembly. The upper support assembly includes an upper support frame having substantially parallel and opposing first and second upper support arms that are joined to a transverse rail. An upper cantilever frame is rigidly attached near the top of the upper support frame, between and in rear of the first and second upper support arms. Attached to the upper cantilever frame is an upper tree-engagement cleat that is centered between and in rear of the first and second upper support arms. The upper tree-engagement cleat provides for contacting the trunk of the tree at two upper engagement locations.

The upper support assembly also includes an upper tree-engagement strap that attaches at one end to the first upper support arm, wraps around the trunk of the tree, and attaches at the other end to the second upper support arm. When cinched tight, the upper tree-engagement strap pulls the top of the upper support frame toward and adjacent the trunk of the tree, thereby causing the upper support frame to be cantilevered on the upper cantilever frame, such that the bottom portion of the frame is suspended outward from the trunk of the tree.

The upper support assembly further includes a seat that may be attached to the upper support frame in at least two seating positions. In each of the seating positions, the seat is positioned below the upper tree-engagement cleat, such that, when the operator is seated in the seat, the seat supports the operator's weight at a point substantially below the locations where the upper tree-engagement cleat engages the trunk of the tree. In this way, the operator's weight maintains tension on the upper tree-engagement strap and causes the upper tree-engagement cleat to be pressed into the trunk of the tree. Even in situations in which the operator's weight is removed from the seat, such as when the operator stands on the platform of the lower assembly, the cantilevered weight of the upper support assembly keeps the cleat tightly engaged with the trunk of the tree. This prevents the upper assembly from inadvertently sliding down or shifting on the tree.

The lower support assembly, which is positioned on the tree below the upper support assembly, includes a lower support frame having substantially parallel and opposing first and second lower support arms joined to a transverse platform. The transverse platform is disposed between the first and second lower support arms, and near the bottom of the lower support frame. A lower cantilever frame is rigidly attached near the top of the lower support frame, between and in rear of the first and second lower support arms. A lower tree-engagement cleat, which is rigidly attached to the lower cantilever frame and substantially centered between and in rear of the first and second lower support arms, contacts the trunk of the tree at two lower tree-engagement locations.

A lower tree-engagement strap attaches at one end to the first lower support arm, wraps around the trunk of the tree, and attaches at the other end to the second lower support arm. When cinched tightly, the lower tree-engagement strap pulls the top of the lower support frame toward and adjacent the trunk of the tree, thereby causing the lower support frame to be cantilevered on the lower cantilever frame, such that the transverse platform is suspended outward and away from the trunk of the tree.

When the operator stands on the transverse platform, the transverse platform supports the operator's weight at a point substantially below the two lower engagement locations where the lower tree-engagement cleat engages the trunk of the tree. In this manner, the operator's weight on the transverse platform maintains tension on the lower tree-engagement strap and causes the lower tree-engagement cleat to be firmly pressed into the trunk of the tree. Even when the operator's weight is removed from the platform, such as when the operator sits in the seat, the cantilevered weight of the lower support frame and platform keep the cleat tightly engaged with the trunk of the tree. This prevents the lower assembly from inadvertently sliding down or shifting on the tree when the operator sits in the seat.

In preferred embodiments, the seat may be attached to the upper support frame in upper and lower seating positions. In the upper seating position, the seat is positioned above the transverse rail, thereby providing an optimum position for bow hunting. In the lower seating position, the seat is positioned below the transverse rail, which provides an optimum position for gun hunting.

In some preferred embodiments, apparatus may be converted into a game cart by attaching the top portion of the upper support frame to the top portion of the lower support frame. The transverse rail serve s as a handle for lifting and pulling the game cart as a pair of wheels on the transverse platform rotate in contact with the ground.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar element s throughout the several drawings as follows.

DETAILED DESCRIPTION OF THE PREFERRED EMBODIMENTS

Figure 1:
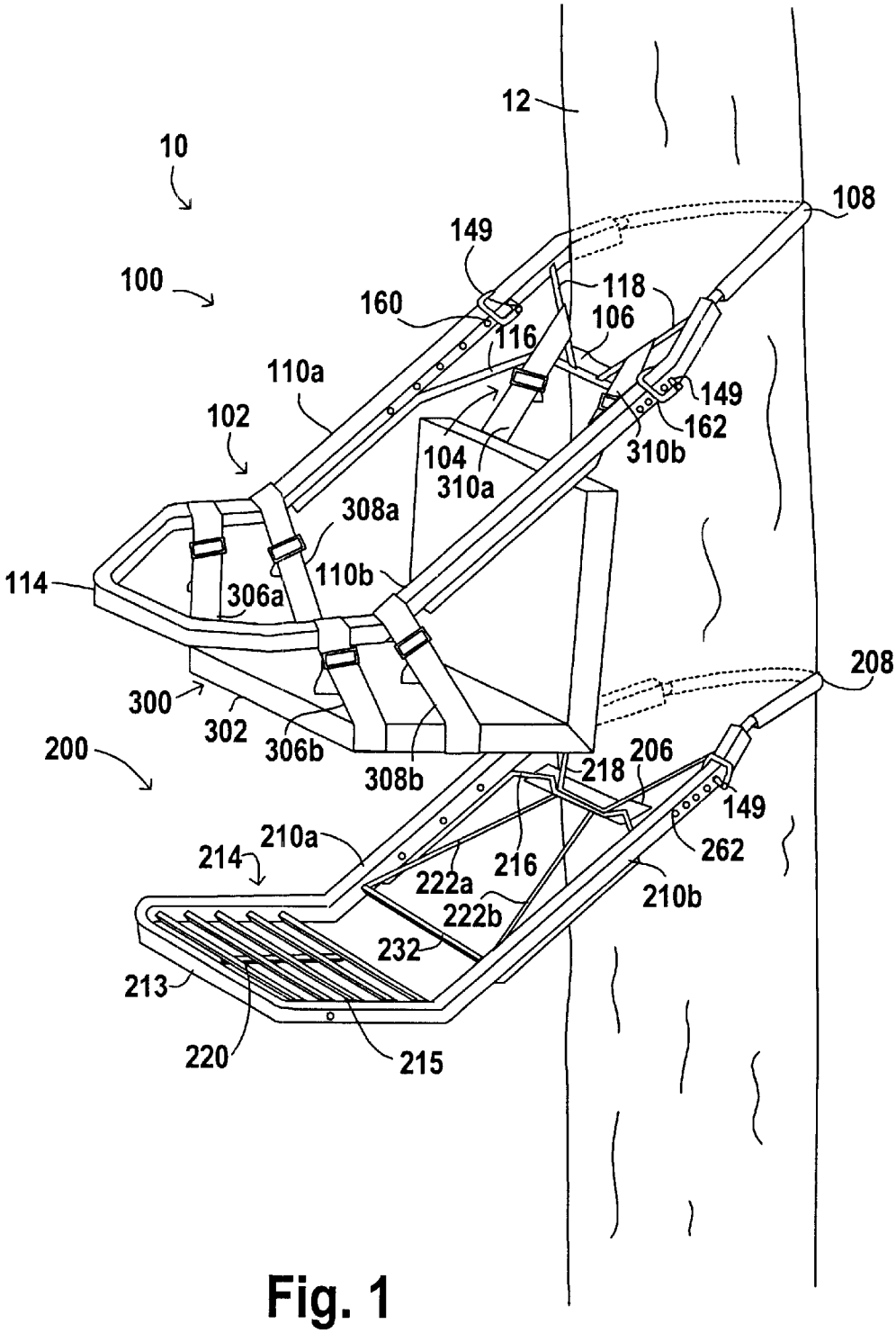
FIG. 1 is a perspective view of an offset climbing tree stand according to a preferred embodiment of the invention.

Shown in FIG. 1 is a preferred embodiment of an offset climbing tree stand 10 according to the present invention. The stand 10 includes two main support assemblies: the upper support assembly 100 and the lower support assembly 200. As described in detail below, the stand 10 may be used for aiding an operator in climbing the trunk of a tree or pole 12, and for comfortably supporting the weight of the operator at an elevated position on the tree or pole 12.

The upper support assembly 100 generally comprises an upper support frame 102, an upper cantilever frame 104, an upper tree-engagement cleat 106, and an upper tree-engagement strap 108. The upper support frame 102 includes a pair of substantially parallel support arms 110*a* and 110*b*, which are also referred to herein as the upper support arms 110*a* and 110*b*. At a lower extremity of the frame 102, the upper support arms 110*a* and 110*b* preferably transition into a transverse rail 114. In the preferred embodiment of the invention, the upper support arms 110*a* and 110*b* are disposed in a plane that forms an angle of approximately 40 to 50 degrees, most preferably 45 degrees, with a plane containing the rail 114. In other words, the angle between the upper support arms 110*a* and 110*b* and the rail 114 is approximately 130 to 140 degrees, and most preferably 135 degrees. This angular relationship between the rail 114 and the arms 110*a* and 110*b* is most clearly represented in the side elevation view of FIGS. 2A–B.

Preferably, the upper support frame 102, including the arms 110*a* and 110*b* and the rail 114, is formed from a single length of one-inch square steel tubing, with the arms 110*a* and 110*b* making a gradual transition into the rail 114. This one-piece construction of the frame 102 eliminates structural failure modes, thereby enhancing the overall safety of the stand 10.

As shown in FIG. 1, the rail 114 preferably consists of five sections with corner angles of approximately 135 degrees between each, and thus has no square comers. As one skilled in the art will appreciate, this geometry minimizes any possible interference between the rail and a hunter's bow as the hunter is aiming the bow. It should be appreciated that the rail could also be formed into a continuous curve, such as a semicircle, and provide a similar advantage.

At the upper extremity of the upper support frame 102, the upper tree-engagement strap 108 is attached at one end to the arm 110*a*, is wrapped around the trunk of the tree 12, and is attached at its other end to the arm 110*b*. In the preferred embodiment of the invention, the strap 108 comprises a 3/16 inch stranded metal cable, such as may be used in aircraft control systems, covered by flexible tubing, such as nylon tubing. In an alternative embodiment, the upper strap 108 (and a lower strap 208 described below) comprises a flexible steel band instead of a cable. Thus, one skilled in the art will appreciate that the invention is not limited to any particular material used in forming the straps 108 and 208, as long as the chosen material can handle the structural load.

In the preferred embodiment, at each end of the strap 108, the cable is formed into a loop which may be inserted into the open end of the tubing of the support arm 110*a* and 110*b*. Each end of the cable is inserted into the open end of the corresponding support arm 110*a* and 110*b* to a desired depth, and a locking pin 149 is inserted through one of several holes 160 in the arm 110*a* and the holes 162 in the arm 110*b* to engage the loops at the ends of the cable.

As shown in FIG. 1, the holes 160 are spaced farther apart than the holes 162. In the preferred embodiment, the holes 160 are spaced by about two inches, and the holes 162 by about ¾ inches. In this manner, the holes 160 provide for "macro-adjustment" of the length of the strap 108, and the holes 162 provide for "micro-adjustment". Further, once the strap length has been set to the desired length using the holes 160 to accommodate the diameter of the tree 12, the upper frame 100 may be easily leveled on the tree 12 using the holes 162.

As shown in FIGS. 1, 2A–B, and 3, the upper cantilever frame 104 connects the upper support frame 102 to the cleat 106. In the preferred embodiment, the upper cantilever frame 104 consists of a lower brace 116, to which the cleat 106 is welded, and an upper brace 118 which is welded to the lower brace 116 and the cleat 106. Preferably, the lower and upper braces 116 and 118 are formed from ¾ inch steel tubing.

The tree-engagement cleat 106 of the preferred embodiment consists of two steel plates, each approximately 7 inches long by 1.5 inches wide by ⅛ inch thick. The cleat plates are welded to the lower brace 116 to form a V. The V shape of the cleat 106 ensures that the cleat 106 engages the trunk of the tree 12 in at least two locations. This arrangement provides much greater stability than can be attained with a single point of contact. It should be appreciated that the scope of the invention is not limited to the form of the cleat 106. Although the preferred embodiment comprises plates, the cleat 106 could also comprise spikes, stakes, studs, or other such devices for firmly engaging the trunk of the tree 12.

As depicted in FIGS. 1, 2A–B, and 3, when the upper strap 108 is cinched tightly about the tree 12, the ends of the upper support arms 110*a* and 110*b* are pulled toward the tree 12. As the ends of the upper support arms 110*a* and 110*b* are pulled toward the tree 12, the support frame 102 pivots about the location on the trunk of the tree 12 where the cleat 106 engages the trunk. As a result, the lower extremity of the frame 102 is suspended outward from the trunk of the tree 12. In the preferred configuration, the strap 108 should be cinched tightly enough to suspend the rail 114 in an approximately horizontal position.

The lower support assembly 200 generally comprises a lower support frame 202, a lower cantilever frame 204, a lower tree-engagement cleat 206, and a lower tree-engagement strap 208. The lower support frame 202 includes a pair of substantially parallel support arms 210*a* and 210*b*, which are also referred to herein as the lower support arms 210*a* and 210*b*. At a lower extremity of the frame 202, the lower support arms 210*a* and 210*b* preferably transition into a transverse platform, generally indicated at 214. In the preferred embodiment of the invention, the lower support arms 210*a* and 210*b* are disposed in a plane that forms an angle of approximately 40 to 50 degrees, most preferably 45 degrees, with a plane containing the platform 214. In other words, the angle between the lower support arms 210*a* and 210*b* and the platform 214 is approximately 130 to 140 degrees, and most preferably about 135 degrees.

Preferably, the lower support frame 202, including the arms 210*a* and 210*b*, and the outer frame 213 of the platform 214, are formed from a single length of one-inch square steel tubing. As with the upper frame 102, this one-piece construction of the lower frame 202 eliminates structural failure modes, thereby enhancing the overall safety of the stand 10. This design is especially advantageous in the lower frame 202, since the weight of the operator is supported completely on the platform 214 when the operator is in a standing position and when the operator is using the stand 10 to climb the tree 12.

As shown in FIG. 1, the platform 214 preferably consists of the outer frame 213 and a series of parallel, evenly spaced, metal bars 215 that span the outer frame 213 in a direction perpendicular to the lower support arms 210*a* and 210*b*. In the preferred embodiment, the platform 214 includes six of the bars 215 spaced apart by about two inches and welded at each end to the outer frame 213. For added support the platform 214 preferably includes a crossbar 220 running transverse to the bars 215 and spot-welded to the bottom of each the bars 215 and to the outer frame 213. Preferably, the bars 215 and the crossbar 220 are formed from ½ inch square steel tubing.

Figure 3:
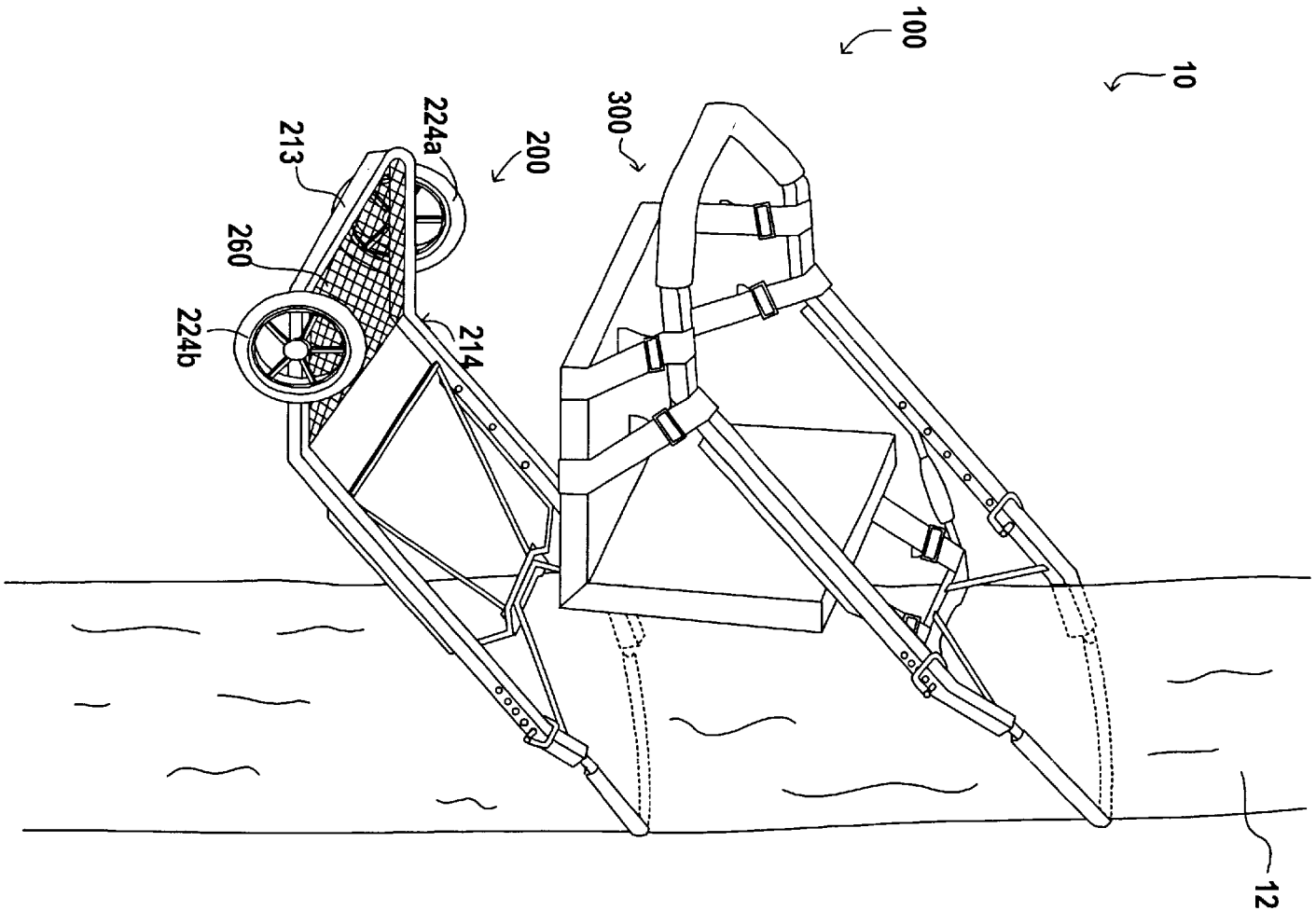
FIG. 3 is a perspective view of the offset climbing tree stand according to an alternative embodiment of the invention.

In an alternative embodiment, as depicted in FIG. 3, the platform 214 consists of a metal mesh 260 spanning the outer frame 213 and supported by the crossbar 220.

With reference to FIG. 1, a lifting bar 232 is rigidly attached between the two lower support arms 210*a–b* and in parallel to the platform 214. The lifting bar 232 is preferably separated from the nearest of the bars 215 by about three inches, thereby providing enough space between the lifting bar 232 and the nearest of the bars 215 for the operator to insert his or her feet therebetween when standing on the platform 214. As described in more detail below, the operator lifts up on the lifting bar using his or her feet when climbing the tree 12.

At the upper extremity of the lower support frame 202, the lower tree-engagement strap 208 is attached at one end to the arm 210*a*, is wrapped around the trunk of the tree 12, and is attached at its other end to the arm 210*b*. In the preferred embodiment of the invention, the strap 208 is of identical construction as the upper strap 108 described above, and attaches to the support arms 210*a* and 210*b* in the same way. Preferably, the lower frame 202 includes adjustment holes 260 on the arm 210*a* and holes 262 on the arm 210*b* to provide for strap length adjustment and frame leveling as described above.

As shown in FIGS. 1, 2A–B, and 3, the lower cantilever frame 204 connects the lower support frame 202 to the cleat 206. In the preferred embodiment, the lower cantilever frame 204 consists of a lower brace 216, to which the cleat 206 is welded, an upper brace 218 which is welded to the lower brace 216 and the cleat 206, and a pair of diagonal braces 222*a* and 222*b* that provide added support between the lower support arms 210*a* and 210*b* and the cleat 206. Preferably, the lower and upper braces 216 and 218 are formed from ¾ inch circular steel tubing, and the diagonal braces are formed from ½ inch square steel tubing.

The lower tree-engagement cleat 206 of the preferred embodiment consists of two steel plates, and has the same construction as that described above for the upper cleat 106.

As depicted in FIGS. 1, 2A–B, and 3, when the lower strap 208 is cinched tightly about the tree 12, the ends of the lower support arms 210*a* and 210*b* are pulled toward the tree 12. As the ends of the lower support arms 210*a* and 210*b* are pulled toward the tree 12, the lower support frame 202 pivots about the location on the trunk of the tree 12 where the cleat 206 engages the trunk. As a result, the platform 214 is suspended outward from the trunk of the tree 12 in a substantially horizontal position.

Figure 2A:
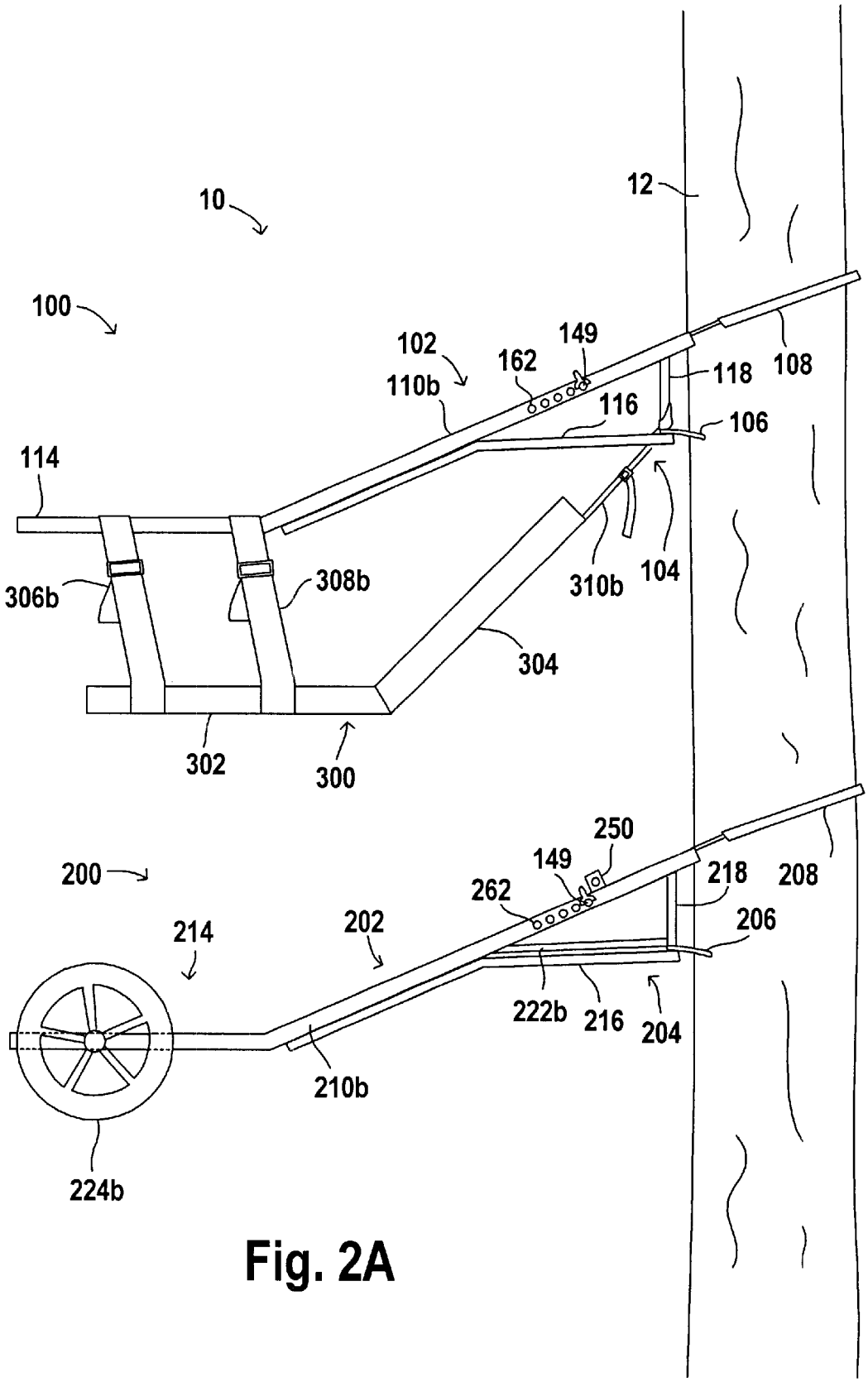
FIGS. 2A–B are side elevation views of the offset climbing tree stand according to a preferred embodiment of the invention.
Figure 2B:
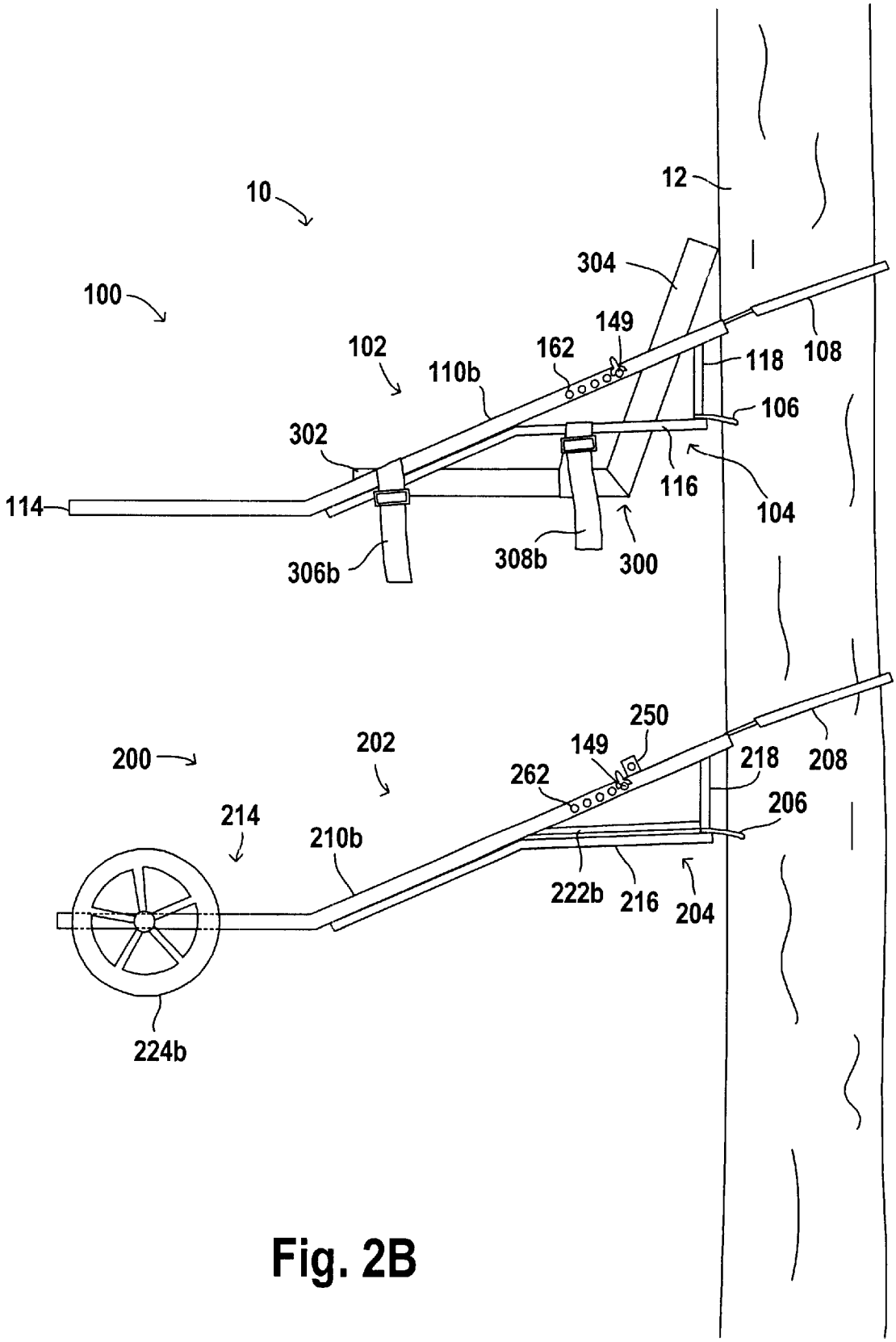

In a preferred embodiment of the invention as depicted in FIGS. 2A–B and 3, the lower support assembly 200 includes a pair of wheels 224*a* and 224*b* connected to the outer frame 213 by a pair of axle bolts. Alternatively, an axle, which passes through a set of holes in the tubing of the outer frame 213 of the platform 214, connects the wheels 224*a* and 224*b*. The purpose and function of the wheels 224*a* and 224*b* are described below.

As shown in FIGS. 1, 2A–B, and 3, the tree stand 10 includes a seat assembly 300 in which the operator may sit when the stand 10 has been secured to the tree 12. Preferably, the seat assembly 300 is attached to the upper support assembly 102 in either a lower seating position, as shown in FIG. 2A, or in an upper seating position, as shown in FIG. 2B, thereby providing the operator a choice of seating positions. In the upper seating position, which is most preferable for bow hunting, the operator is seated above the transverse rail 114. In this upper position, the rail 114 is well below where the lower end of a bow would be positioned in most downward shooting angles, and thus does not interfere with the aiming of the bow. As discussed above, the lack of square comers on the rail 114 further minimizes possible interference between the rail 114 and the bow as the hunter is aiming the bow. In the lower seating position, which is preferred for gun hunting, the operator is seated such that the rail 114 may be conveniently used as a gun rest or elbow rest to aid the operator in steadying the gun while aiming.

The dual-position seating feature of the present invention provides a level of versatility not previously available in climbing tree stands. No prior stand has provided one seating position best suited for bow-hunting and another seating position best suited for gun hunting. Thus, the dual-position seating feature of the present invention offers a significant advantage over prior tree stands.

Further, in most prior climbing tree stands, the lower section has been used only to facilitate climbing, and has had little use while the operator is seated in the upper section. In contrast, with the present invention, the platform 214 of the lower assembly 200 provides a place for the operator to stand while hunting. Thus, the operator has a choice of three hunting positions: (1) standing on the platform 214, (2) sitting in the seat assembly 300 in the bow-hunting position, or (3) sitting in the seat assembly 300 in the gun-hunting position. This level of versatility is unavailable in existing tree stands.

As shown in FIGS. 1, 2A–B, and 3, the seat assembly 300 includes a seat 302 attached to a seat back 304. The manner of attachment of the seat 302 to the seat back 304 allows the seat 302 and back 304 to fold together, so that the seat is not in the operator's way when the operator is using the stand 10 for climbing the tree 12. Preferably, the seat assembly 300 includes a set of adjustable-length straps 306*a–b* and 308*a–b* attached to the underside of the seat 302 for suspending the seat 302 from the upper frame 102. When in the lower seating position, as shown in FIG. 2A, the straps 306*a–b* and 308*a–b* are preferably wrapped and secured around the transverse rail 114. A pair of adjustable-length straps 310*a–b*, which are attached to the back of the seat back 304, preferably wrap around the upper brace 118 or the lower brace 116 to support the seat back 304 when the seat assembly 300 is in the lower seating position. The height and leveling of the seat assembly 300 may be adjusted by appropriate adjustment of the lengths of the straps 306*a–b*, 308*a–b*, and 310*a–b* .

When in the upper seating position, as shown in FIG. 2B, the straps 306*a–b* are preferably wrapped and secured around the lower brace 116. In this position, the seat back 304 is preferably supported by leaning the seat back 304 against the trunk of the tree 12, or against the upper brace 118.

Figure 4:
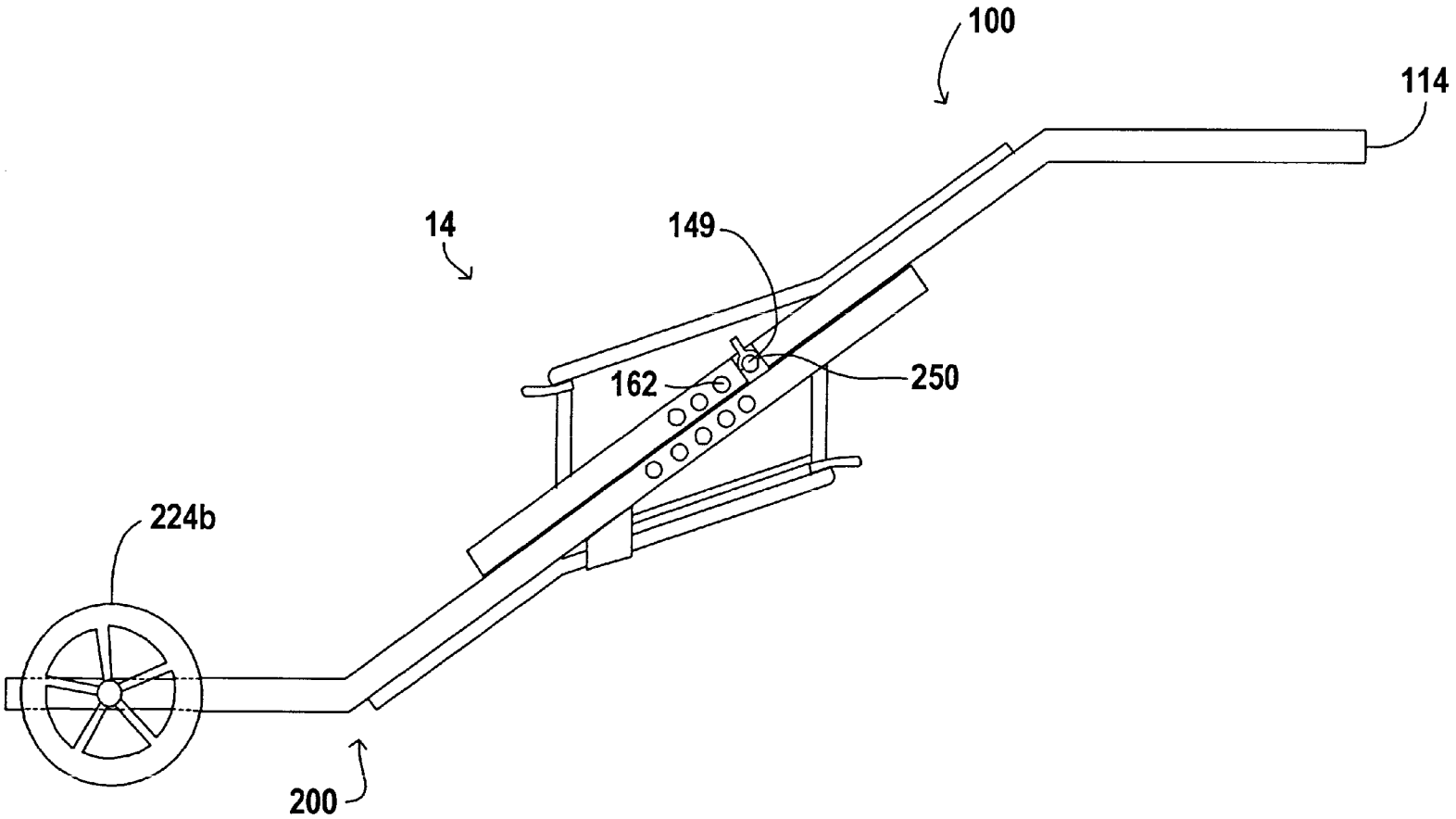
FIG. 4 is a side elevation view of the offset climbing tree stand converted into a game cart according to a preferred embodiment of the invention.

As depicted in FIG. 4, the tree stand 10 is convertible into a game cart 14, such as may be used for hauling a deer or other such large game. After the upper and lower assemblies 100 and 200 have been detached from the tree, the game cart 14 is formed by rotating the upper assembly lengthwise by 180 degrees, and attaching the support arms 110*a–b* of the upper assembly 100 to the support arms 210*a–b* of the lower assembly 200. As shown in FIG. 4, attachment brackets 250 are permanently attached to the support arms 210*a–b* of the lower assembly 200, such as by welding. The attachment brackets 250 include holes which align with two of the holes 160 and 162 on the support arms 110*a–b* of the upper assembly 100. A pair of locking pins 149 are provided that are inserted through the holes in the attachment brackets 250 and the holes 160 and 162, thereby securing the upper assembly 100 to the lower assembly 200. After the game has been strapped or otherwise secured on top of the cart 14, the operator may use the rail 114 of the upper assembly 100 as a handle to lift and pull the front of the cart 14 as the cart 14 rolls on the wheels 224*a–b* .

The tree stand 10 is used to climb the tree 12 as follows. First, the upper and lower assemblies 100 and 200 are attached to the trunk of the tree 12 as shown in FIG. 1. The operator then steps between the upper support arms 110*a–b* and stands on the platform 214 facing the tree 12 with his feet inserted between the lifting bar 232 and the platform 214. The operator puts his hands on the top of the upper support arms 110*a–b* and pushes down while pulling his knees toward his chest, thereby lifting up on the lifting bar 232 with his feet. The upward movement of the bar 232 causes the cleat 206 to disengage from the trunk of the tree 12 such that the lower assembly 200 is free to move upward. After moving the lower assembly 200 up as far as possible, the operator eases his weight back down on the platform 214 so that the cleat 206 engages the tree 12. The operator then lifts upward on the upper support arms 110*a–b* to disengage the upper cleat 106 from the tree 12 so that the upper assembly is free to move upward. After lifting the upper assembly 100 up as far as possible, the operator again presses down with his arms so that the upper cleat 106 again firmly engages the tree 12. This process is repeated until the operator has reached the desired height in the tree 12.

It is contemplated, and will be apparent to those skilled in the art from the preceding description and the accompanying drawings that modifications and/or changes may be made in the embodiments of the invention. For example, although the preferred material for many of the load-bearing structures in the stand 10 is steel, other materials could be used, such as aluminum or other metals or alloys, or composite materials, including carbon fiber materials. Further, although the preferred method of attaching together metal members of the structure is by welding, one skilled in the art will appreciate that other means of fastening may also be employed. It should also be appreciated that the upper and lower support assemblies 100 and 200 could be constructed as unitary structures using molding techniques, such as composite molding. Thus, the invention is not limited to any particular type of material or construction technique. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An apparatus for aiding an operator in attaining an elevated position in a tree and for providing support for the operator while in the elevated position, the apparatus comprising:

an upper support assembly including:

an upper support frame having upper and lower extremities and comprising:

substantially parallel and opposing first and second upper support arms; and a transverse rail disposed at the lower extremity of the upper support frame, and between and joined to the first and second upper support arms at a first angle relative to a plane coinciding with the first and second upper support arms, wherein the first and second upper support arms incline upwardly from the transverse rail;

an upper cantilever frame rigidly attached to the upper support frame between the first and second upper support arms and above the transverse rail;

an upper tree-engagement cleat rigidly attached to the upper cantilever frame and substantially centered between the first and second upper support arms and disposed above the transverse rail, the upper tree-engagement cleat for contacting a trunk of the tree at at least two upper engagement locations;

an upper tree-engagement strap for attaching at one end thereof to the first upper support arm, wrapping around the trunk of the tree, and attaching at another end thereof to the second upper support arm, the upper tree-engagement strap for pulling the upper extremity of the upper support frame toward and adjacent the trunk of the tree, thereby causing the upper support frame to be cantilevered on the upper cantilever frame, such that the lower extremity of the upper support frame is suspended outward from the trunk of the tree; and a seat attached to the transverse rail and the upper cantilever frame, and suspended therefrom in a seating position in which the seat is at a level below the upper tree-engagement cleat when the upper support assembly is engaged with the tree, whereby, when the operator is seated in the seat, the seat supports the operator's weight at a point substantially below the two upper engagement locations where the upper tree-engagement cleat engages the trunk of the tree, such that the operator's weight maintains tension on the upper tree-engagement strap and causes the upper tree-engagement cleat to be pressed into the trunk of the tree; and a lower support assembly disposed below the upper support assembly, the lower support assembly including:

a lower support frame having upper and lower extremities and comprising:

substantially parallel and opposing first and second lower support arms; and a transverse platform disposed between and joined to the first and second lower support arms at a second angle relative to a plane coinciding with the first and second lower support arms;

a lower cantilever frame rigidly attached to the lower support frame adjacent the upper extremity, and between the first and second lower support arms;

a lower tree-engagement cleat rigidly attached to the lower cantilever frame and substantially centered between the first and second lower support arms and disposed above the transverse platform, the lower tree-engagement cleat for contacting the trunk of the tree at at least two lower engagement locations; and a lower tree-engagement strap for attaching at one end thereof to the first lower support arm, wrapping around the trunk of the tree, and attaching at another end thereof to the second lower support arm, the lower tree-engagement strap for pulling the upper extremity of the lower support frame toward and adjacent the trunk of the tree, thereby causing the lower support frame to be cantilevered on the lower cantilever frame, such that the lower extremity of the lower support frame is suspended outward and away from the trunk of the tree;

the transverse platform suspended substantially below the at least two lower engagement locations where the lower tree-engagement cleat engages the trunk of the tree when the lower support frame is cantilevered on the lower cantilever frame, whereby, when the operator stands on the transverse platform, the transverse platform supports the operator's weight at a point substantially below the two lower engagement locations where the lower tree-engagement cleat engages the trunk of the tree, such that the operator's weight maintains tension on the lower tree-engagement strap and causes the lower tree-engagement cleat to be pressed into the trunk of the tree.

2. The apparatus of claim 1 wherein the transverse rail further comprises five contiguous rail sections, each of the rail sections joined to an adjacent one of the rail sections at an angle of about 135 degrees.

3. The apparatus of claim 1 wherein the transverse rail and the upper support arms are formed from one continuous piece of material.

4. The apparatus of claim 1 wherein the upper and lower tree-engagement straps each further comprise a section of metal cable covered by flexible tubing.

5. The apparatus of claim 1 wherein the first angle is from about 130 degrees to 140 degrees.

6. The apparatus of claim 1 wherein the second angle is from about 130 degrees to 140 degrees.

7. The apparatus of claim 1 wherein the transverse platform further comprises a platform outer frame connected to and spanning the distance between the lower support arms at the lower extremity of the lower support frame, and wherein the platform outer frame and the lower support arms are formed from one continuous piece of material.

8. The apparatus of claim 7 wherein the transverse platform further comprises a plurality of substantially parallel bars connected to and spanning the platform outer frame.

9. The apparatus of claim 7 wherein the transverse platform further comprises a metal mesh connected to and spanning the platform outer frame.

10. The apparatus of claim 1 wherein the upper and lower tree-engagement cleats each further comprise at least one metal plate.

11. The apparatus of claim 1 wherein the upper and lower tree-engagement straps each have effective lengths determined by attachment locations on the upper and lower support arms at which the ends of the upper and lower tree-engagement straps attach to the upper and lower support arms, wherein macro-adjustment of the effective lengths of the upper and lower tree-engagement straps is determined by attachment locations distributed along the first upper support arm and along the first lower support arm, and wherein micro-adjustment of the effective lengths of the upper and lower tree-engagement straps is determined by attachment locations distributed along the second upper support arm and along the second lower support arm.

12. The apparatus of claim 11 further comprising:

the first upper support arm and the first lower support arm each having a plurality of spaced apart macro-adjustment holes therein, the macro-adjustment holes distributed along the first upper support arm and the first lower support arm at a first spacing;

the second upper support arm and the second lower support arm each having a plurality of spaced apart micro-adjustment holes therein, the micro-adjustment holes distributed along the first upper support arm and the first lower support arm at a second spacing that is less than the first spacing;

the upper tree-engagement strap and the lower tree-engagement strap each having an attachment loop at each end thereof; and at least four attachment pins for attaching the upper tree-engagement strap to the first and second upper support arms, and for attaching the lower tree-engagement strap to the first and second lower support arms, including:

a first attachment pin for passing through the attachment loop at one end of the upper tree-engagement strap and into one of the macro-adjustment holes in the first upper support arm, thereby securing the upper tree-engagement strap to the first upper support arm;

a second attachment pin for passing through the attachment loop at the other end of the upper tree-engagement strap and into one of the micro-adjustment holes in the second upper support arm, thereby securing the upper tree-engagement strap to the second upper support arm;

a third attachment pin for passing through the attachment loop at one end of the lower tree-engagement strap and into one of the macro-adjustment holes in the first lower support arm, thereby securing the lower tree-engagement strap to the first lower support arm; and a fourth attachment pin for passing through the attachment loop at the other end of the lower tree-engagement strap and into one of the micro-adjustment holes in the second lower support arm, thereby securing the lower tree-engagement strap to the second lower support arm, where selection of the macro-adjustment holes used for attachment of the upper and lower tree-engagement straps provides for macro-adjustment of the effective lengths of the upper and lower tree-engagement straps, and where the micro-adjustment holes used for attachment of the upper and lower tree-engagement straps provides for micro-adjustment of the effective lengths of the upper and lower tree-engagement straps.

* * * * *